US008080984B1

(12) United States Patent
Geynet

(10) Patent No.: US 8,080,984 B1
(45) Date of Patent: Dec. 20, 2011

(54) REPLICA TRANSISTOR VOLTAGE REGULATOR

(75) Inventor: Lionel Geynet, Cork (IE)

(73) Assignee: Cypress Semiconductor Corporation, San Jose, CA (US)

( * ) Notice: Subject to any disclaimer, the term of this patent is extended or adjusted under 35 U.S.C. 154(b) by 523 days.

(21) Appl. No.: 12/154,169

(22) Filed: May 21, 2008

Related U.S. Application Data

(60) Provisional application No. 60/931,216, filed on May 22, 2007.

(51) Int. Cl.
*G05F 1/40* (2006.01)
*G05F 3/16* (2006.01)

(52) U.S. Cl. ..... 323/280; 323/316; 327/540

(58) Field of Classification Search ..... 323/312–317, 323/269, 273–275, 280; 327/538–543
See application file for complete search history.

(56) References Cited

U.S. PATENT DOCUMENTS

| | | | | |
|---|---|---|---|---|
| 4,851,759 | A | 7/1989 | Blauschild | |
| 4,884,161 | A | 11/1989 | Atherton et al. | |
| 4,893,030 | A | 1/1990 | Shearer et al. | |
| 5,637,992 | A | 6/1997 | Edwards | |
| 5,661,395 | A | 8/1997 | Johnson et al. | |
| 6,157,176 | A | 12/2000 | Pulvirenti et al. | |
| 6,157,178 | A | 12/2000 | Montanari | |
| 6,222,353 | B1 | 4/2001 | Pattamatta et al. | |
| 6,232,757 | B1 | 5/2001 | Afghahi et al. | |
| 6,249,177 | B1 | 6/2001 | Savage et al. | |
| 6,373,231 | B1 | 4/2002 | Lacey et al. | |
| 6,424,131 | B1 | 7/2002 | Yamamoto et al. | |
| 6,441,593 | B1 | 8/2002 | Saripella | |
| 6,501,256 | B1 | 12/2002 | Jaussi et al. | |
| 6,522,111 | B2 | 2/2003 | Zadeh et al. | |
| 6,566,851 | B1 | 5/2003 | Schuelke et al. | |
| 6,601,936 | B2 | 8/2003 | McDonald | |
| 6,661,214 | B1 | 12/2003 | Hann et al. | |
| 6,879,142 | B2 | 4/2005 | Chen | |
| 7,002,401 | B2 | 2/2006 | Khalid | |
| 7,009,374 | B2 | 3/2006 | Neaves | |
| 7,026,802 | B2 | 4/2006 | Gradinariu | |
| 7,106,042 | B1 * | 9/2006 | Jackson | 323/316 |
| 7,319,314 | B1 * | 1/2008 | Maheshwari et al. | 323/313 |

OTHER PUBLICATIONS

USPTO Notice of Allowance for U.S. Appl. No. 11/313,342, dated Apr. 17, 2007; 4 pages.
USPTO Non-Final Rejection for U.S. Appl. No. 11/313,342, dated Sep. 21, 2006; 6 pages.
USPTO Notice of Allowance for U.S. Appl. No. 11/004,564, dated May 1, 2006; 4 pages.

(Continued)

*Primary Examiner* — Jessica Han

(57) ABSTRACT

A voltage regulator is provided having high accuracy, low PSRR, and no headroom limitation. Generally, the regulator includes: an operational amplifier (OPAMP) having a non-inverting input coupled to a reference voltage; an output source follower coupled to and controlled by an output of the OPAMP, the output source follower including a drain coupled to a voltage source and a source coupled to an output-node of the regulator; a replica source follower coupled to and controlled by the OPAMP, the replica source follower including a drain coupled to the voltage source and a source coupled to circuit ground through a resistor network; and a feedback circuit extending from the output-node through a feedback resistor to the source of the replica source follower and through at least a first resistor of the resistor network to an inverting input of the OPAMP to couple a feedback voltage thereto. Other embodiments are also provided.

19 Claims, 3 Drawing Sheets

OTHER PUBLICATIONS

USPTO Non-Final Rejection for U.S. Appl. No. 11/004,564, dated Jan. 4, 2006; 5 pages.
USPTO Notice of Allowance for U.S. Appl. No. 10/965,445, dated Oct. 26, 2005; 4 pages.
USPTO Non-Final Rejection for U.S. Appl. No. 10/965,445, dated May 3, 2005; 5 pages.
USPTO Miscellaneous Action for U.S. Appl. No. 10/965,445, dated Jan. 5, 2005; 1 page.

* cited by examiner

REPLICA TRANSISTOR VOLTAGE REGULATOR

CROSS-REFERENCE TO RELATED APPLICATIONS

The present application claims the benefit of priority under 35 U.S.C. 119(e) to U.S. Provisional Patent Application Ser. No. 60/931,216 entitled "A Replica Transistor Voltage Regulator Architecture," filed May 22, 2007, which application is hereby incorporated by reference in its entirety.

TECHNICAL FIELD

The present invention relates generally to voltage regulators, and more particularly to a circuit and method to substantially prevent or interrupt reverse current flow into a voltage regulator from an output thereof.

BACKGROUND OF THE INVENTION

Voltage regulator circuits or voltage regulators are widely used in many applications to provide a nearly constant output voltage at a desired level that is substantially independent of a poorly specified and often fluctuating input voltage and output conditions (i.e., variation in a load current).

One type of voltage regulator is a replica transistor voltage regulator. In a replica transistor voltage regulator a voltage established in a replica leg using a dummy or replicated load and is replicated in an output leg to provide a desired output voltage ($V_{out}$). Typically, the output leg is made using larger semiconductor devices capable of carrying higher current demanded by devices or circuits coupled to an output-node of the regulator. $V_{out}$ from the output-node in the output leg is regulated substantially independent of an output load by forcing the output leg to track voltage in the replica leg as closely as possible.

An example of a conventional replica transistor voltage regulator is shown in FIG. 1. Referring to FIG. 1, the voltage regulator 100 includes an operational amplifier (OPAMP 102) having a non-inverting input coupled to a reference voltage ($V_{ref}$), a replica leg 104 coupled between a voltage source ($V_{pwr}$) and a circuit ground 106, and an output leg 108 coupled between $V_{pwr}$ and an output-node 110. The replica leg 104 includes a replica transistor 112 coupled to and controlled by a voltage ($V_{gate}$) output from the OPAMP 102, and a replicated or dummy load 114, represented here as a resistance ($R_{rep}$) and a parallel capacitance ($C_{rep}$), through which the replica transistor 112 is coupled to ground 106. The output leg 108 includes a second, typically larger output transistor 116 coupled to the OPAMP 102 and controlled by $V_{gate}$, and the output-node 110 through which the output transistor is coupled to an output load, represented here by a current ($I_{load}$) and a capacitance ($C_{load}$). The OPAMP 102 is configured in negative feedback so that the output of the OPAMP, $V_{gate}$, forces the $V_{out}$ voltage to the same voltage as a voltage ($V_{rep}$) in the replica leg 102. The replica transistor 112 and output transistor 116 are ratioed so that the current provided to output leg 108 is much larger than that of the replica leg 104 at the desired output voltage.

Although the above described circuit is widely used, and has the advantages of a simple architecture that occupies a small area on a silicon die or substrate, it is not wholly satisfactory for a number of reasons. In particular, conventional replica transistor voltage regulators suffer from poor accuracy, typically allowing the output voltage to vary by about 7-10% or more from a desired output voltage, making it unsuitable for use in many circuits.

An alternative voltage regulator architecture further includes a current conveyor coupled between the first leg of the circuit and an output-node in the replica leg. The current conveyor provides feedback between an output voltage ($V_{out}$) and an operational amplifier (OPAMP) at the input to the voltage regulator. The OPAMP controls current supplied to the current conveyor based on a comparison between a reference voltage and a feedback voltage. The current conveyor forces $V_{out}$ to follow the input or source voltage. Although voltage regulators including current conveyors provide regulation with a relatively good accuracy in output voltage, typically varying by as little as 5%, they too suffer from a number of drawbacks or disadvantages including poor headroom of less than about 50 millivolts (mV), and a poor power supply rejection ratio (PSRR), typically of about −5 decibels (dB) or greater. By headroom it is meant a maximum allowable shift in input or source voltage for which the voltage regulator can adjust or compensate in the output voltage $V_{out}$. PSRR is a term widely used in the field of electronics to quantify noise coupled from a power supply to a considered node, such as the output-node. More fundamentally, the current conveyor architecture requires a relatively large area on a die or substrate on which it is fabricated, utilizing from about 133K to 150K square microns ($\mu m^2$), making it unsuitable for use in many integrated circuits (ICs).

Accordingly, there is a need for a voltage regulator that does not suffer from the above shortcomings of conventional designs and methods. In particular, there is a need for a highly accurate voltage regulator that has a good PSRR and no headroom limitations while occupying a small area on the substrate on which it is fabricated.

SUMMARY OF THE INVENTION

The present invention provides a solution to these and other problems, and offers further advantages over conventional voltage regulators and methods of operating the same.

In one aspect, the present invention is directed to a voltage regulator for regulating a voltage ($V_{out}$) at an output-node of the regulator in response to a comparison between a reference voltage ($V_{ref}$) and a feedback voltage ($V_{fbk}$) from the output-node. In one embodiment, the voltage regulator comprises: (i) an operational amplifier (OPAMP) having a non-inverting input coupled to $V_{ref}$; (ii) an output source follower coupled to and controlled by an output of the OPAMP, the output source follower including a drain coupled to a voltage source and a source coupled to the output-node of the voltage regulator; (iii) a replica source follower coupled to and controlled by the output of the OPAMP in parallel with the output source follower, the replica source follower including a drain coupled to the voltage source and a source coupled to a circuit ground through a resistor network; and (iv) a feedback circuit extending from the output-node through a feedback resistor to the source of the replica source follower and through at least a first resistor of the resistor network to an inverting input of the OPAMP to couple $V_{fbk}$ thereto to regulate $V_{out}$ the output-node in response to a comparison between $V_{fbk}$ and $V_{ref}$. Generally, the feedback resistor is a small resistor having a resistance of about 100 Ohms or less.

Preferably, the voltage regulator is a replica transistor voltage regulator comprising a replica leg including the replica source follower and the resistor network, and an output leg comprising the output source follower and further comprising a leaker transistor coupled between the source of the output source follower and circuit ground. More preferably, the leaker transistor comprises a drain coupled to the source of the output source follower and a source coupled to circuit ground. The leaker transistor is controlled by a DC bias voltage to leak current from the output-node to provide a constant minimum current flowing in the output source follower, thereby improving circuit stability and avoid floating nodes.

The voltage regulator of the present invention is capable of providing a $V_{out}$ that varies by 4.5% or less, a power supply rejection ratio (PSRR) equal to or less than about −20 decibels (dB), and maximum headroom of at least 280 millivolts (mV). In addition, the voltage regulator can be implemented on a substrate utilizing an area of less than about 100K microns ($\mu m^2$), making it particularly suitable for integrated circuit (IC) applications.

In another embodiment, the voltage regulator comprises a feedback circuit including a feedback transistor coupled between the source of the replica source follower and the output-node. The feedback transistor is controlled by a DC biasing voltage that can be varied to adjust a magnitude of the feedback voltage ($V_{fbk}$). In certain preferred embodiments, the feedback transistor is connected as a source follower having a source coupled to the source of the replica source follower and a drain coupled to the source of the output source follower. More preferably, the feedback transistor further comprises a bulk terminal coupled to the source thereof to improve the stability of the feedback circuit.

In another aspect the invention is directed to a method of operating a replica transistor voltage regulator to improve accuracy, while providing a good power supply rejection ratio (PSRR) and substantially no headroom limitations. In one embodiment, the method includes the step of coupling a feedback voltage ($V_{fbk}$) from the output-node to an inverting input of an OPAMP through a feedback resistor coupled between the output-node and a source of a replica source follower. In an alternative embodiment the feedback circuit comprises a feedback transistor coupled between the output-node and the source of the replica source follower, and the method includes the further step of controlling a biasing voltage to the feedback transistor to adjust a magnitude of $V_{fbk}$.

BRIEF DESCRIPTION OF THE DRAWINGS

These and various other features and advantages of the present invention will be apparent upon reading of the following detailed description in conjunction with the accompanying drawings and the appended claims provided below, where:

DETAILED DESCRIPTION

The present invention is directed to a replica transistor voltage regulator having a feedback loop between sources of an output source follower and a replica source follower.

The voltage regulator and method of the present invention are particularly useful in battery operated devices, such as a wireless computer mouse and other like devices, which include integrated voltage regulators fabricated on a common semiconductor die or substrate with integrated circuits (ICs) of the devices.

In the following description, for purposes of explanation, numerous specific details are set forth in order to provide a thorough understanding of the present invention. It will be evident, however, to one skilled in the art that the present invention may be practiced without these specific details. In other instances, well-known structures, and techniques are not shown in detail or are shown in block diagram form in order to avoid unnecessarily obscuring an understanding of this description.

Reference in the description to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment. The term "to couple" as used herein may include both to directly connect and to indirectly connect through one or more intervening components.

Briefly, the voltage regulator circuit or voltage regulator of the present invention includes a feedback circuit between a source of an output source follower in an output leg and a source of a replica source follower in a replica leg. The voltage regulator provides exceptional accuracy and a good power supply rejection ratio (PSRR), while substantially eliminating headroom issues and reducing the size of the voltage regulator on a semiconductor die or substrate as compared to conventional voltage regulators having current conveyor architectures.

The voltage regulator and methods for operating the same according to various embodiments of the present invention will now be described in detail with reference to FIGS. 2 and 3. For purposes of clarity, many of the details of integrated circuit design in general and design of voltage regulators in particular that are widely known and are not relevant to the present invention have been omitted from the following description.

Figure 1:
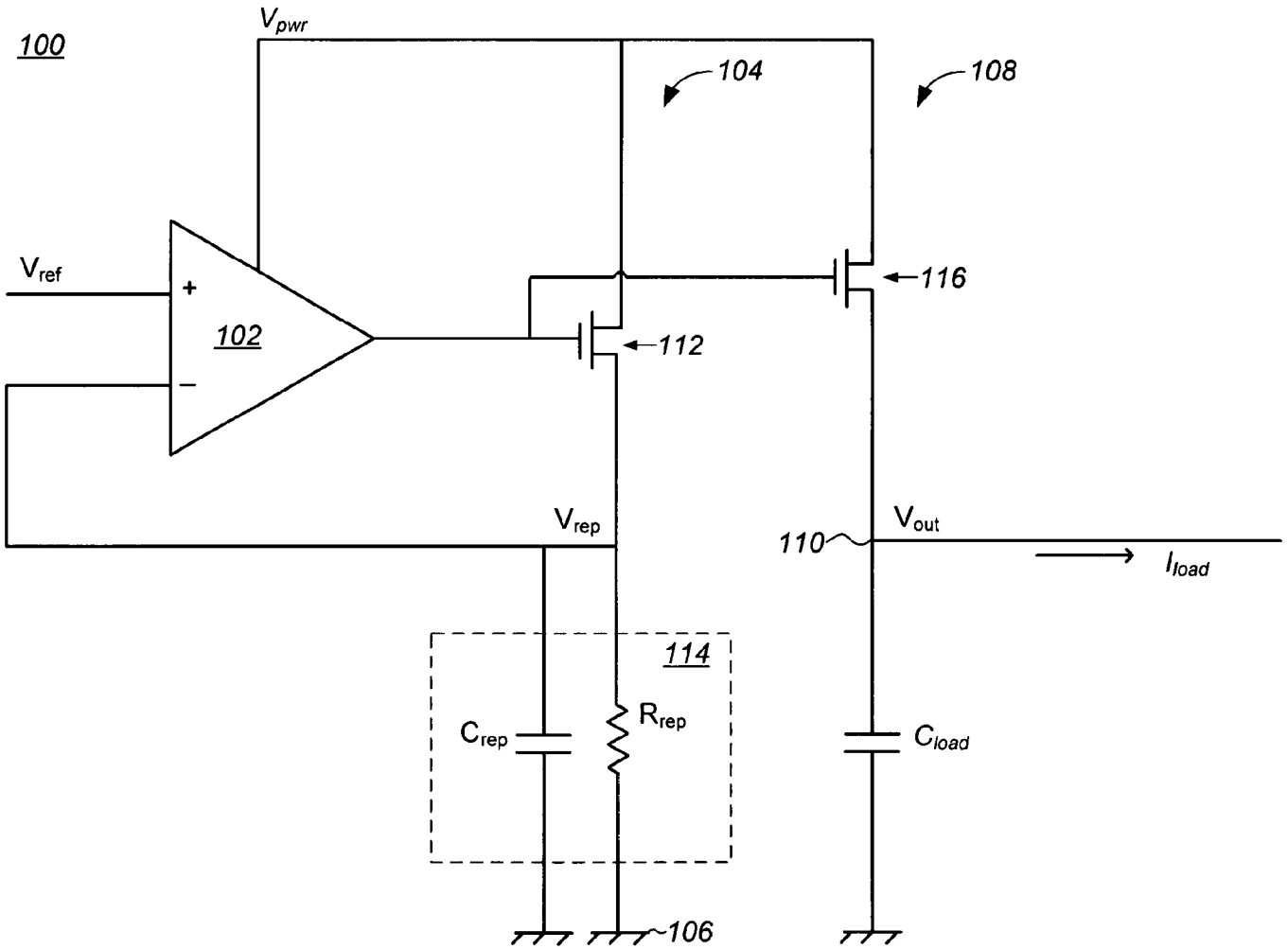
FIG. 1 (Related Art)
FIG. 1 is a simplified schematic diagram of a conventional replica transistor voltage regulator according to an embodiment of the present invention.
Figure 2:
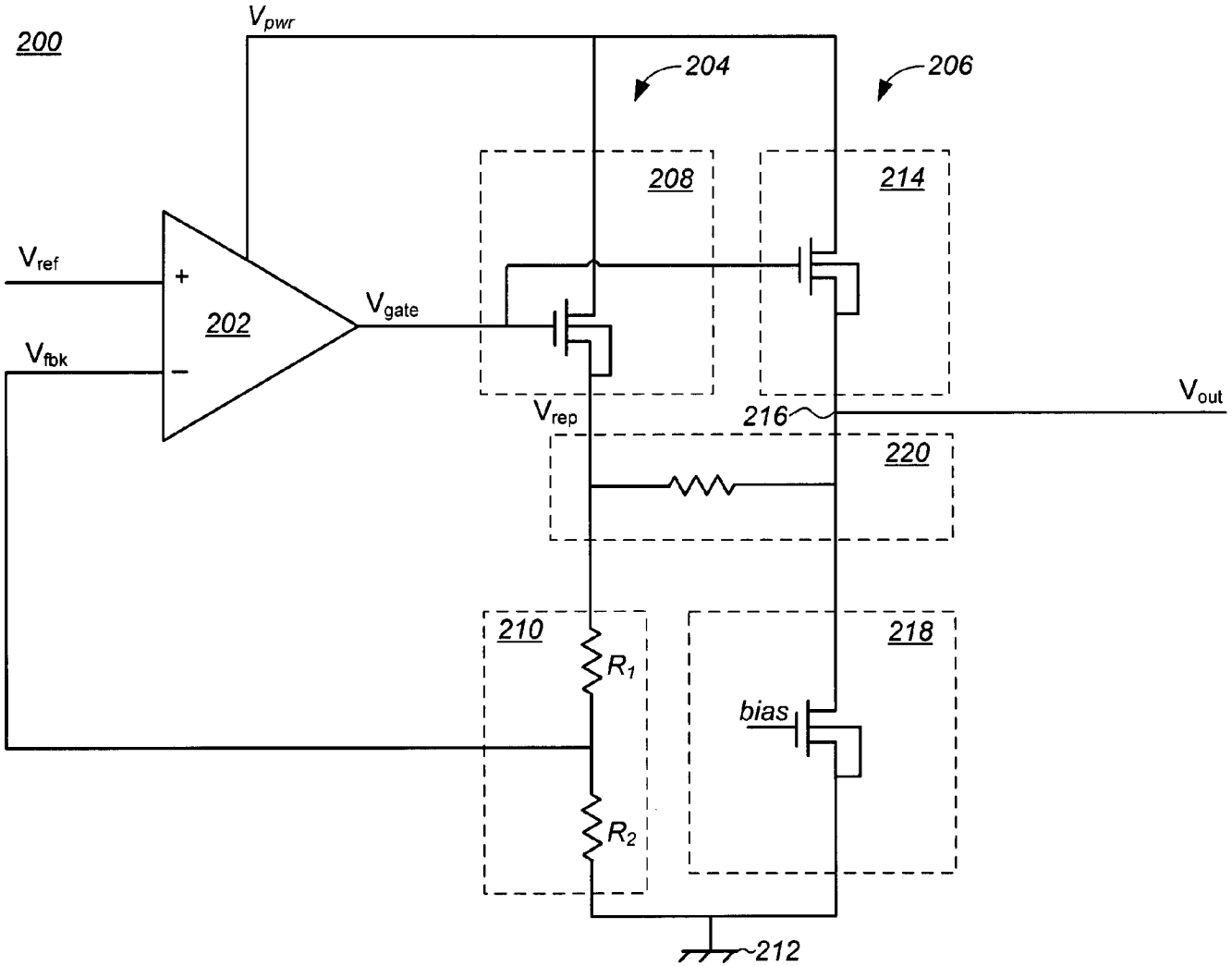
FIG. 2 is a simplified schematic diagram of a voltage regulator according to an embodiment of the present invention.

Referring to FIG. 2, the voltage regulator 200 generally includes an operational amplifier (OPAMP 202) having a non-inverting input coupled to a predetermined reference voltage ($V_{ref}$), a replica leg 204 and an output leg 206 to provide a regulated output voltage ($V_{out}$) to a circuit or load (not shown) coupled to the voltage regulator. The replica leg 204 includes a first metal-oxide-semiconductor (MOS) transistor 208 connected as a source follower and including a gate coupled to an output ($V_{gate}$) of the OPAMP 202, a drain coupled to a voltage source ($V_{pwr}$), and a source coupled through a resistor network 210 to a circuit ground 212 and through at least a first resistor ($R_1$) of the resistor network to an inverting input of the OPAMP. The output leg 206 includes a second MOS transistor 214 connected as a source follower and including a gate coupled to the output ($V_{gate}$) of the OPAMP 202, a drain coupled to the voltage source ($V_{pwr}$) and a source coupled to an output node 216 of the voltage regulator 200.

Generally, the second MOS transistor or output source follower 214 is scaled to be n times as large as the first MOS transistor or replica source follower 208. That is a ratio of a power or current carrying capacity of the output source follower 214 to the replica source follower 208 can be n:1 where n is greater than 1, thereby enabling the output source follower to provide a desired current for the output leg 208 as well as a load device (not shown) coupled to the output-node 216.

Preferably, as in the embodiment shown, the output leg 206 further includes a leaker transistor 218 coupled between the source of the output source follower 214 and circuit ground 212. More preferably, the leaker transistor 218 comprises a drain coupled to the source of the output source follower 214 and a source coupled to circuit ground 212, and is controlled by a DC bias voltage (bias) to provide a constant minimum current flowing in the output source follower, thereby improving circuit stability and avoid floating nodes. More preferably, as in the embodiment shown, one or more of the MOS transistors of the replica source follower 208, output source follower 214 and leaker transistor 218 further include a bulk terminal coupled to the source to improve the stability of the voltage regulator 200.

In accordance with a first embodiment of the present invention, the voltage regulator 200 further includes a feedback loop or circuit extending from the output-node 216 through a feedback resistor ($R_{fbk}$ 220) to the source of the replica source follower 208 and through the first resistor ($R_1$) of the resistor network 210 to the inverting input of the OPAMP 202. The feedback circuit couples a feedback voltage ($V_{fbk}$) to the inverting input of the OPAMP 202 to control the output source follower 214 in response to a comparison between $V_{fbk}$ and $V_{ref}$, thereby regulating the voltage ($V_{out}$) at the output-node 216. It will be appreciated using resistor feedback from the output-node 212 of the voltage regulator 200 to the input, i.e., the inverted input of the OPAMP 202, provides a more accurate regulation than can be achieved in a conventional replica transistor voltage regulator using only feedback from a replica leg. It will further be appreciated that the feedback results in a larger magnitude of $V_{rep}$, which will cause the OPAMP 202 output voltage ($V_{gate}$) to decrease sufficiently to ensure that transistors 208 and 214 are saturated, thereby improving the power supply rejection ratio (PSRR) of the voltage regulator 200.

The value of resistance selected for the feedback resistor 220 will depend on a number of factors including, a desired accuracy of regulation and a desired stability of the voltage regulator. The smaller the feedback resistor 220, the larger the magnitude of the feedback ($V_{fbk}$) and the more accurate the voltage regulation achieved. However, the larger $V_{fbk}$ the less stable the voltage regulator will be, and therefore there is a tradeoff between regulator accuracy and stability. Preferably, the feedback resistor 220 is a small resistor having a resistance of about 100 Ohms or less, and more preferably having a resistance in the tens of Ohms or less.

The value of resistance selected for the resistor network 210 and a ratio of the resistance of resistor ($R_1$) to a resistance of other resistors in the resistor network but not in a feedback path, represented in this figure by resistor ($R_2$), will depend on a number of factors including, a desired amount or magnitude of feedback, the resistance of the feedback resistor 220, and a desired current flow through the replica leg 204. Generally, the resistor network 210 can include a total resistance on the order of several tens of Ohms to several hundreds of Ohms, and ratio of resistance of $R_1$ to $R_2$ of from about 0, that is no resistor $R_1$, to about 1:10.

Figure 3:
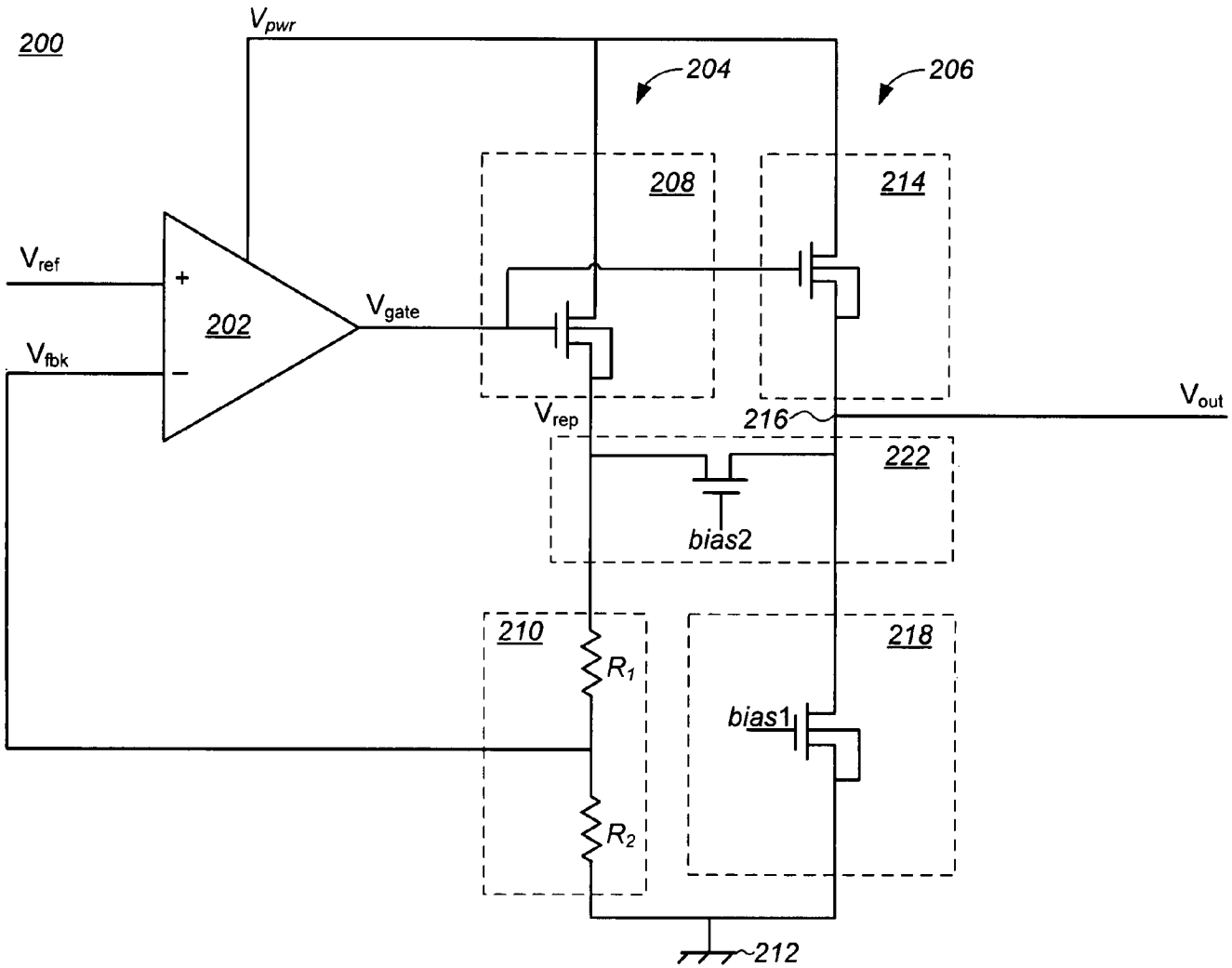
FIG. 3 is a simplified schematic diagram of a voltage regulator according to another embodiment of the present invention.

In another embodiment, shown in FIG. 3, the feedback resistor ($R_{fbk}$) in the feedback loop or circuit is replaced with a feedback transistor 222 coupled between the output-node 216 and the first resistor ($R_1$) of the resistor network 210. More preferably, the feedback transistor 222 is a MOS transistor including a control node or gate coupled to and controlled by a second DC bias voltage (bias2) different from the first DC bias voltage (bias1) used to control the leaker transistor 218. It will be appreciated that this embodiment enables the amount or magnitude of the feedback ($V_{fbk}$) to be further adjusted by varying the second DC bias voltage (bias2). In one version of this embodiment, the feedback MOS transistor can include a bulk terminal coupled to a source terminal of the transistor to improve the stability of the feedback circuit.

Although shown and described above as including n-channel MOSFET as the replica and output transistors, it will be appreciated that the voltage regulator of the present can also be implemented using, for example, bipolar NPN transistors in a common collector configuration.

Advantages of the circuit of the present invention over previous or conventional approaches include: (i) high accuracy having an output voltage that varies by about 4.2% or less; (ii) a good PSRR of about −20 dB or less; (iii) substantially no headroom limitations having a margin of 280 millivolts (mV) or more; and (iv) a small silicon area on the substrate on which it is fabricated utilizing less than about 100K $\mu m^2$ or at least 30% less than existing architectures.

The foregoing description of specific embodiments and examples of the invention have been presented for the purpose of illustration and description, and although the invention has been described and illustrated by certain of the preceding examples, it is not to be construed as being limited thereby. They are not intended to be exhaustive or to limit the invention to the precise forms disclosed, and many modifications, improvements and variations within the scope of the invention are possible in light of the above teaching. It is intended that the scope of the invention encompass the generic area as herein disclosed, and by the claims appended hereto and their equivalents. The scope of the present invention is defined by the claims, which includes known equivalents and unforeseeable equivalents at the time of filing of this application.

What is claimed is:

1. A voltage regulator comprising:

an operational amplifier (OPAMP) having a non-inverting input coupled to a reference voltage (Vref);

an output source follower coupled to and controlled by an output of the OPAMP, the output source follower including a drain coupled to a voltage source and a source coupled to an output-node of the voltage regulator;

a replica source follower coupled to and controlled by the output of the OPAMP in parallel with the output source follower, the replica source follower including a drain coupled to the voltage source and a source coupled to a circuit ground through a resistor network; and a feedback circuit extending from the output-node through a feedback resistor to the source of the replica source follower and through at least a first resistor of the resistor network to an inverting input of the OPAMP to couple a feedback voltage (Vfbk) thereto to regulate a voltage (Vout) at the output-node in response to a comparison between Vfbk and Vref.

2. A voltage regulator according to claim 1, wherein the feedback resistor comprises a resistance equal to or less than about 100 Ohms.

3. A voltage regulator according to claim 1, wherein the voltage regulator is a replica transistor voltage regulator comprising a replica leg including the replica source follower and the resistor network, and an output leg comprising the output source follower and further comprising a leaker transistor coupled between the source of the output source follower and circuit ground.

4. A voltage regulator according to claim 3, wherein the leaker transistor comprises a drain coupled to the source of the output source follower and a source coupled to circuit ground, and wherein the leaker transistor is controlled by a bias voltage to leak current from the output-node to provide at least a constant minimum current flow in the output source follower.

5. A voltage regulator according to claim 1, wherein the voltage regulator has a Vout that varies by 4.5% or less from a predetermined Vout.

6. A voltage regulator according to claim 1, wherein the voltage regulator has a power supply rejection ratio (PSRR) equal to or less than about −20 decibels (dB).

7. A voltage regulator according to claim 1, wherein the voltage regulator has maximum headroom of at least 280 millivolts (mV).

8. A voltage regulator according to claim 1, wherein the voltage regulator utilizes a small area on a substrate on which it is implemented, having an area of less than about 100K microns (μm2).

9. A voltage regulator comprising:

an operational amplifier (OPAMP) having a non-inverting input coupled to a predetermined reference voltage (Vref);

an output source follower coupled to and controlled by an output of the OPAMP, the output source follower including a drain coupled to a voltage source and a source coupled to an output-node of the voltage regulator;

a replica source follower coupled to and controlled by the output of the OPAMP in parallel with the output source follower, the replica source follower including a drain coupled to the voltage source and a source coupled to a circuit ground through a resistor network; and a feedback circuit extending from the output-node through a feedback transistor to the source of the replica source follower and through at least a first resistor of the resistor network to an inverting input of the OPAMP to couple a feedback voltage (Vfbk) thereto to regulate a voltage (Vout) at the output-node in response to a comparison between Vfbk and Vref.

10. A voltage regulator according to claim 9, wherein the feedback transistor is controlled by a biasing voltage that can be varied to adjust a magnitude of Vfbk.

11. A voltage regulator according to claim 10, wherein the feedback transistor is connected as a source follower having a source coupled to the source of the replica source follower and a drain coupled to the source of the output source follower.

12. A voltage regulator according to claim 11, wherein the feedback transistor further comprises a bulk terminal coupled to the source thereof to improve the stability of the feedback circuit.

13. A voltage regulator according to claim 9, wherein the voltage regulator is a replica transistor voltage regulator comprising a replica leg including the replica source follower and the resistor network, and an output leg comprising the output source follower and further comprising a leaker transistor coupled between the source of the output source follower and circuit ground to provide at least a constant minimum current flow in the output source follower.

14. A voltage regulator according to claim 9, wherein the voltage regulator has a Vout that varies by 4.5% or less from a predetermined Vout.

15. A voltage regulator according to claim 9, wherein the voltage regulator has a power supply rejection ratio (PSRR) equal to or less than about −20 decibels (dB).

16. A voltage regulator according to claim 9, wherein the voltage regulator has maximum headroom of at least 280 millivolts (mV).

17. A voltage regulator according to claim 9, wherein the voltage regulator utilizes a small area on a substrate on which it is implemented, having an area of less than about 100K microns (μm2).

18. A method for operating a voltage regulator comprising:

coupling a reference voltage (Vref) to a non-inverting input of an operational amplifier (OPAMP);

controlling with a voltage (Vgate) from an output of the OPAMP an output source follower coupled thereto, the output source follower including a drain coupled to a voltage source and a source coupled to an output-node of the voltage regulator;

controlling with Vgate a replica source follower coupled to the output of the OPAMP in parallel with the output source follower, the replica source follower including a drain coupled to the voltage source and a source coupled to a circuit ground through a resistor network; and coupling a feedback voltage (Vfbk) from the output-node to an inverting input of the OPAMP through a feedback circuit extending through at least a first resistor of the resistor network to regulate a voltage (Vout) at the output-node in response to a comparison between Vfbk and Vref, wherein the feedback circuit comprises a feedback resistor coupled between the output-node and the source of the replica source follower.

19. A method for operating a voltage regulator comprising:

coupling a reference voltage (Vref) to a non-inverting input of an operational amplifier (OPAMP);

controlling with a voltage (Vgate) from an output of the OPAMP an output source follower coupled thereto, the output source follower including a drain coupled to a voltage source and a source coupled to an output-node of the voltage regulator;

controlling with Vgate a replica source follower coupled to the output of the OPAMP in parallel with the output source follower, the replica source follower including a drain coupled to the voltage source and a source coupled to a circuit ground through a resistor network; and coupling a feedback voltage (Vfbk) from the output-node to an inverting input of the OPAMP through a feedback circuit extending through at least a first resistor of the resistor network to regulate a voltage (Vout) at the output-node in response to a comparison between Vfbk and Vref, wherein the feedback circuit comprises a feedback transistor coupled between the output-node and the source of the replica source follower and controlled by a biasing voltage that can be varied to adjust a magnitude of Vfbk.

* * * * *